US008418521B2

(12) United States Patent
Xia et al.

(10) Patent No.: US 8,418,521 B2
(45) Date of Patent: Apr. 16, 2013

(54) DOUBLE CLOSED HYDRAULIC MOULD STAND

(75) Inventors: Hanguan Xia, Jiansu (CN); Juchen Xia, Wuhan (CN); Guoan Hu, Wuhan (CN); Xinyun Wang, Wuhan (CN); Junsong Jin, Wuhan (CN); Yi Dong, Jiangsu (CN)

(73) Assignees: Jiansu Pacific Precision Forging Co., Ltd., Jiangyan, Jiangsu (CN); Huazhong University of Science and Technology, Hongshan District, Wuhan (CN)

( * ) Notice: Subject to any disclaimer, the term of this patent is extended or adjusted under 35 U.S.C. 154(b) by 385 days.

(21) Appl. No.: 12/935,910

(22) PCT Filed: Mar. 30, 2009

(86) PCT No.: PCT/CN2009/071065

§ 371 (c)(1),
(2), (4) Date: Oct. 1, 2010

(87) PCT Pub. No.: WO2009/124481

PCT Pub. Date: Oct. 15, 2009

(65) Prior Publication Data

US 2011/0030443 A1 Feb. 10, 2011

(30) Foreign Application Priority Data

Apr. 11, 2008 (CN) ..... 2008 1 0047323

(51) Int. Cl.
*B21J 9/12* (2006.01)
*B21J 9/18* (2006.01)

(52) U.S. Cl.
USPC ..... 72/453.02; 72/453.03; 72/353.6

(58) Field of Classification Search ..... 72/352, 72/353.2, 353.6, 354.2, 355.2, 357, 453.01–453.03, 72/466.7, 432; 100/269.06
See application file for complete search history.

(56) References Cited

U.S. PATENT DOCUMENTS 4,977,773 A * 12/1990 Mito et al. ..... 72/353.6
7,059,165 B2 * 6/2006 Siegert et al. ..... 72/355.6
8,082,771 B2 * 12/2011 Song et al. ..... 72/453.02

FOREIGN PATENT DOCUMENTS

CN 1385263 A * 12/2002
CN 1644267 A * 7/2005

OTHER PUBLICATIONS

International Search Report of PCT/CN2009/071065.

*Primary Examiner* — Debra Sullivan
(74) *Attorney, Agent, or Firm* — Global IP Services; Tianhua Gu

(57) ABSTRACT

A double closed hydraulic mold stand is provided, which includes an up bottom plate (1), a down bottom plate (21), an up mold plate (8), a down mold plate (20), four guide sleeves (42), four guide columns (45), and a four mechanical linkage velocity ratio mechanism. The four guide sleeves (42) and the four guide columns (45) are distributed symmetrically and slidingly fit each other. An up piston cylinder, a down piston cylinder, an up bed piece (11), a down bed piece (31), an up concave mold seat (15), a down concave mold seat, an up concave mold (16), and a down concave mold (33) are fixed at the up bottom plate and the down bottom plate. An up pin-lift (3), a down pin-lift (24), an up punch pin seat (4), a down punch pin seat (22), an up punch pin (38), and a down punch pin (36) form an up piston and a down piston respectively. The up piston cylinder and the down piston cylinder have a split combined structure, which is convenient for manufacturing, installation, and maintenance. The up piston cylinder is repositioned by using a cylindrical spring. The down piston cylinder is repositioned by using a cylindrical spring and a nitrogen gas spring. The reposition is strong and fast, which facilitates vacuum oil absorption, power consumption saving, and productivity improvement. The present invention can be installed on a single-acting hydraulic press or a single-acting mechanical press for use, and has a wide application range.

4 Claims, 3 Drawing Sheets

DOUBLE CLOSED HYDRAULIC MOULD STAND

CROSS REFERENCE TO RELATED PATENT APPLICATION

The present application is the US national stage of PCT/CN2009/071065 filed on Mar. 30, 2009, which claims the priority of the Chinese patent application No. 200810047323.0 filed on Apr. 11, 2008, which application is incorporated herein by reference.

BACKGROUND OF THE INVENTION

1. Field of Invention

The present invention relates to a hydraulic device in a forge forming technology.

2. Related Art

Referring to "Precision Forging Mould Manual" (Hu Yamin, China Machine Press, Beijing, 2002), an existing three-pin axle and a small-sized cross-axle double closed mould stand are formed of a mould stand and a flexible clamping device. The mould stand includes an up mould plate, an up concave mould seat, an up punch pin, a down mould plate, a down concave mould seat, a down punch pin, and four sets of symmetrically distributed guide columns and guide sleeves. The flexible clamping device includes cylindrical polyurethane rubber, a retaining ring and a connecting bolt, cylinder helical spring, and a stop bolt. The parts and elements are symmetrically distributed in the up mould plate and the down mould plate. During flashless die forging, the cylinder polyurethane rubber and the cylinder helical spring generate a clamping force. After the mould forging is ended, the cylinder helical spring and the cylinder polyurethane rubber push the up concave mould and the down concave mould away from up and down baffles. The advantage is as follows. The mould stand structure is simple and has a low manufacturing cost. However, the polyurethane rubber and the helical spring generate a clamping force which is small and unstable.

A double-closed hydraulic mould stand which can be used for bevel gear and cross-axle flashless cold precision forging at the same time is proposed in Precision forming of aluminum and steel (Hyoji Yoshimuya, Katsuhisa Tanka, Journal of Materials Processing Technology 98 (2000), 196-204), which is formed of a mould stand, and two sets (up and down) of a piston cylinder and a speed ratio mechanism. The advantage is that the clamping force is large, the process application range is wide, and the use of the speed ratio mechanism can enable the up punch pin and the down punch pin to extrude forging at the same speed or different speeds according to process requirements. However, both the up and down cylinders are integral structures, and a bottom shape of the cylinder is complicated, thus causing difficulties in processing and installation. When the annular piston in the up cylinder and the up concave mould seat, the up concave mould bed piece, and the up concave mould ring return upward when the mould forging is ended, the parts fall down completely depending on their own weight. Once being stuck on the up concave mould and the up punch pin, it is very difficult for the cross-axle forging to fall down. The up bearing support and the up hinge base are in a semi arc surface contact, which require difficult processing, so a contact area therebetween is easily decreased, and maintenance is difficult.

SUMMARY OF THE INVENTION

The present invention is directed to a double closed hydraulic mould stand, which solves problems that exist in an existing flashless die forging double closed hydraulic mould stand having parts such as a cross-axle, a three-pin axle, and a bevel gear, which is used for precision forging of parts such as a cross-axle, a three-pin axle, and a bevel gear.

In the double closed hydraulic mould stand according to the present invention, an up bottom plate 1 and an annular up mould plate 8 are connected through bolts, and a down bottom plate 21 and an annular down mould plate 20 are connected through bolts. Four symmetrically distributed guide sleeves 42 are fixed under the up mould plate 8, four symmetrically distributed guide columns 45 are fixed on the down mould plate 20, the guide columns are sleeved by stop blocks 44, and the guide sleeves and the guide columns slidingly fit each other in a piston mode.

An up piston cylinder is fixed at the up bottom plate 1. A cover of the up piston cylinder is connected to an up bed piece 11 and an up concave mould 16 in sequence. The up concave mould 16 is sleeved by an up concave mould prestressed ring 39 and is fixed on the up concave mould seat 15 through an up concave mould fixing ring 37. The up concave mould seat 15 is fixedly connected to the cover of the up piston cylinder. An up pin-lift 3, an up punch pin seat 4, and an up punch pin 38 that are in contact in sequence form an up piston, which slidingly fits an up gliding sleeve 40, the up bed piece 11, and the up concave mould 16 from top to bottom.

A down piston cylinder is fixed at the down bottom plate 21. A cover of the down piston cylinder is connected with a down bed piece 31 and a down concave mould 33 in sequence. The down concave mould 33 is sleeved by a down concave mould prestressed ring 35 and is fixed on an intermediate floating plate 18 through a down concave mould fixing ring 32. The intermediate floating plate 18 is fixedly connected to the cover of the down piston cylinder. A down pin-lift 24, a down punch pin seat 22, and a down punch pin 36 in contact in sequence form a down piston, which slidingly fits a gliding sleeve 25, the down bed piece 31, and the down concave mould 33 from top to bottom.

A speed ratio mechanism is fixed between the up mould plate 8 and the down mould plate 20. The speed ratio mechanism includes an up bearing support 12, an up hinge base 14, a down hinge base 19, a four-bar linkage 17, the intermediate floating plate 18, and small guide columns 49. Two up bearing supports 12 are fixedly connected at two sides of the up mould plate 8 symmetrically, and two down hinge bases 19 are fixedly connected at corresponding positions at two sides of the down mould plate 20. The up bearing support 12 is connected to the up hinge base 14, and the up hinge base 14 and the down hinge base 19 are connected through the four-bar linkage 17. The four symmetrically distributed small guide columns 49 are fixed under the intermediate floating plate 18, and slidingly fit four symmetrically distributed small guide sleeves 47 disposed on the down mould plate 20 in a piston mode.

An up cylinder bottom 6, an up annular piston 7, and an up cylinder cover 9 are disposed inside the up mould plate 8 in sequence, and form an up piston cylinder. A circular slot is provided at a bottom surface of the annular up cylinder bottom 6 and is connected to the up bottom plate 1 through bolts. An annular slot is provided at a top surface of an up annular piston 7 and connected to the up cylinder cover 9 through bolts. A cylindrical spring is installed between the annular slot on the up annular piston and the circular slot of the up cylinder bottom 6. The up mould plate 8 serves as a cylinder body of the up piston cylinder and slidingly fits the up annular piston 7 and the up cylinder cover 9.

The up concave mould seat 15 is sleeved by an up stop sleeve 13, and the two slidingly fit each other. The up stop sleeve 13 is fixed on the up mould plate 8.

A down cylinder bottom 26, a down annular piston 28, and a down cylinder cover 29 are disposed inside the down mould plate 20 in sequence and form a down piston cylinder. The annular down cylinder bottom 26 has a circular slot at a top surface and is connected to the down bottom plate 21 through bolts. The down annular piston 28 has an annular slot at a bottom surface and is connected to the down cylinder cover 29 through bolts. A cylindrical spring is installed between the annular slot of the down annular piston and the circular slot of the down cylinder bottom 26. The down mould plate 20 serves as a cylinder body of the down piston cylinder, and slidingly fits the down annular piston 28 and the down cylinder cover 29.

Four nitrogen gas springs 48 are symmetrically disposed on the down mould plate 20.

The double closed hydraulic mould stand serving as a preferred technical solution is described as follows.

An up annual ring 10 is connected at a bottom surface of the up mould plate 8, and a sealing ring is installed at an inner circle of the up annual ring 10 and slidingly fits the up cylinder cover 9.

A down annual ring 30 is connected at a top surface of the down mould plate 20, and a sealing ring is installed at an inner circle of the down annual ring 30 and slidingly fits the down cylinder cover 29.

A contact surface between the up hinge base and the up bearing support is a plane.

The double closed hydraulic mould stand serving as another preferred technical solution is described as follows.

Two oil holes are opened at a rear side of the up mould plate corresponding to the gap between the up cylinder bottom 6 and the up annular piston 7. Two oil holes are opened at a rear side of the down mould plate corresponding to the gap between the corresponding down cylinder bottom 26 and the down annular piston 28. Each oil hole is connected to a hydraulic pump station through oil pipes.

Compared with an existing double closed hydraulic mould stand for cross-axle flashless precision forging in Precision Forging Mould Manual, in the present invention, a clamping force is generated by using pressure oil in an up piston cylinder and a down piston cylinder, so the clamping force is great and stable, and the process application range is wide. Compared with the double closed hydraulic mould stand for cross-axle flashless die forging proposed by Hyoji Yoshimuya et al., in the present invention, both the up piston cylinder and the down piston cylinder have a combined structure of a cylinder bottom, a cylinder body, a cylinder cover, and an annular fixing ring. The up cylinder body and the down cylinder body are the up mould plate and the down mould plate. Such a combined structure can be easily processed, installed, and maintained. A cylindrical helical spring is installed between the up cylinder bottom and the annular piston in the up piston cylinder. When the mould forging is ended and the up concave mould and the up punch pin return upward together, the up concave mould is repositioned downward rapidly, so vacuum oil absorption is generated at an up cavity of the up piston cylinder. A cylindrical helical spring and a nitrogen gas spring are installed between the down cylinder bottom and the annular piston in the down cylinder, when the mould forging is ended, the two springs push the down concave mould, the down concave mould bed piece and the intermediate floating plate and the down concave mould seat integrally secured upward rapidly, so the return force is greater than that when only the nitrogen gas spring is adopted, and the return speed is higher. In the present invention, a contact surface between the up bearing support and the up hinge base is a plane, which can be processed more easily than the arc surface, and the abrasion is uniform, so as to keep a size of the contact area unchanged.

When the present invention is used, the up bottom plate is fixed at a bottom surface of a sliding block of the single-acting hydraulic press or single-acting mechanical press. The down bottom plate is fixed on a surface of a worktable of the single-acting hydraulic press or the mechanical press. The left and right stop blocks are disassembled, thus ensuring the use on the mechanical press.

The up piston cylinder body and the down piston cylinder body according to the present invention adopt a split combined structure, which facilitates manufacturing, installation, and maintenance. The up piston cylinder is repositioned by using a cylindrical spring, and the down piston cylinder is repositioned by using a cylindrical spring and a nitrogen gas spring, so the reposition is strong and fast, which facilitates vacuum oil absorption, power consumption saving, and productivity improvement. A contact between an up hinge base and an up bearing support of the speed ratio mechanism is designed into a plane, which can be easily processed and the abrasion is uniform in use, so that a size of a contact area is constant. The double closed mould stand can be installed on the single-acting hydraulic press for use, and can also be installed on the single-acting mechanical press for use after the stop blocks are disassembled, so the adaptation range is wide.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
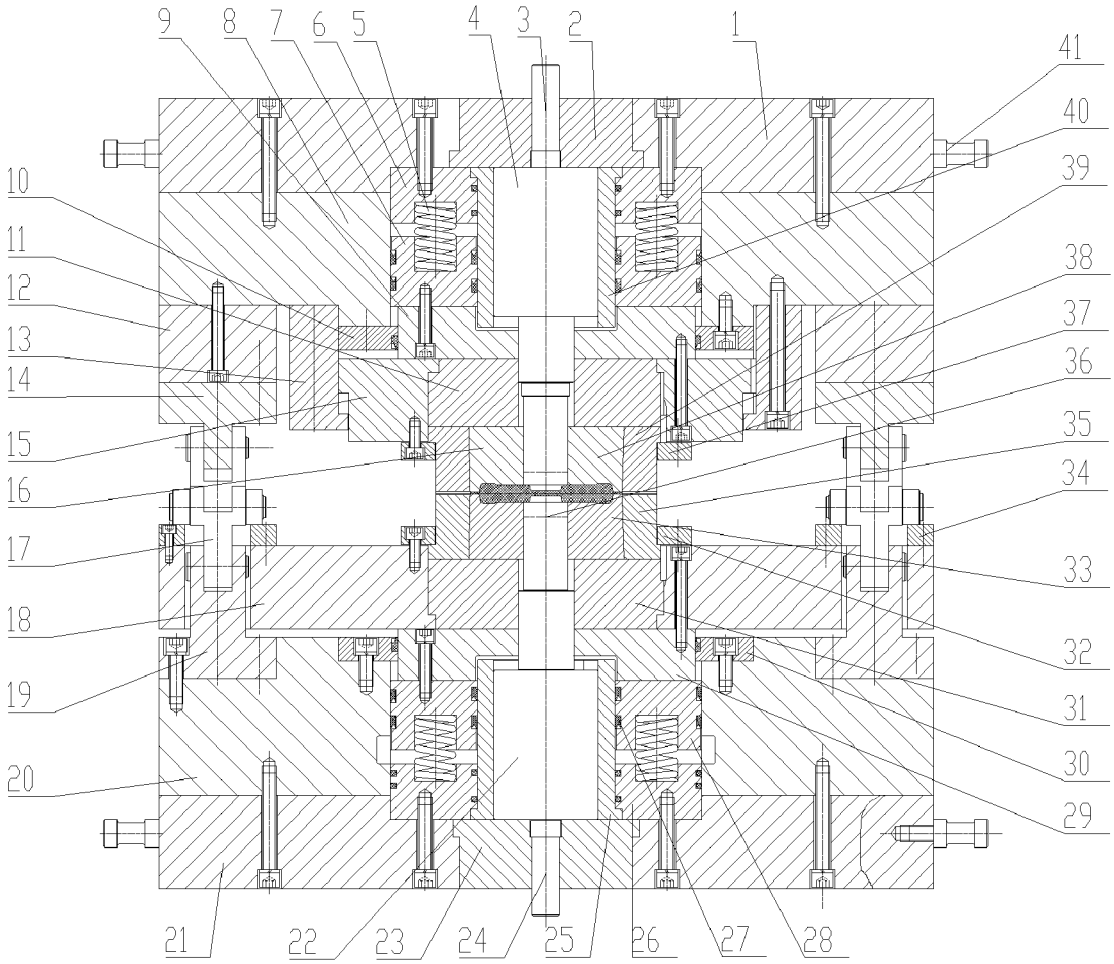
FIG. 1 is a schematic view according to an embodiment of the present invention, that is, a sectional view along A-A in FIG. 2.
Figure 2:
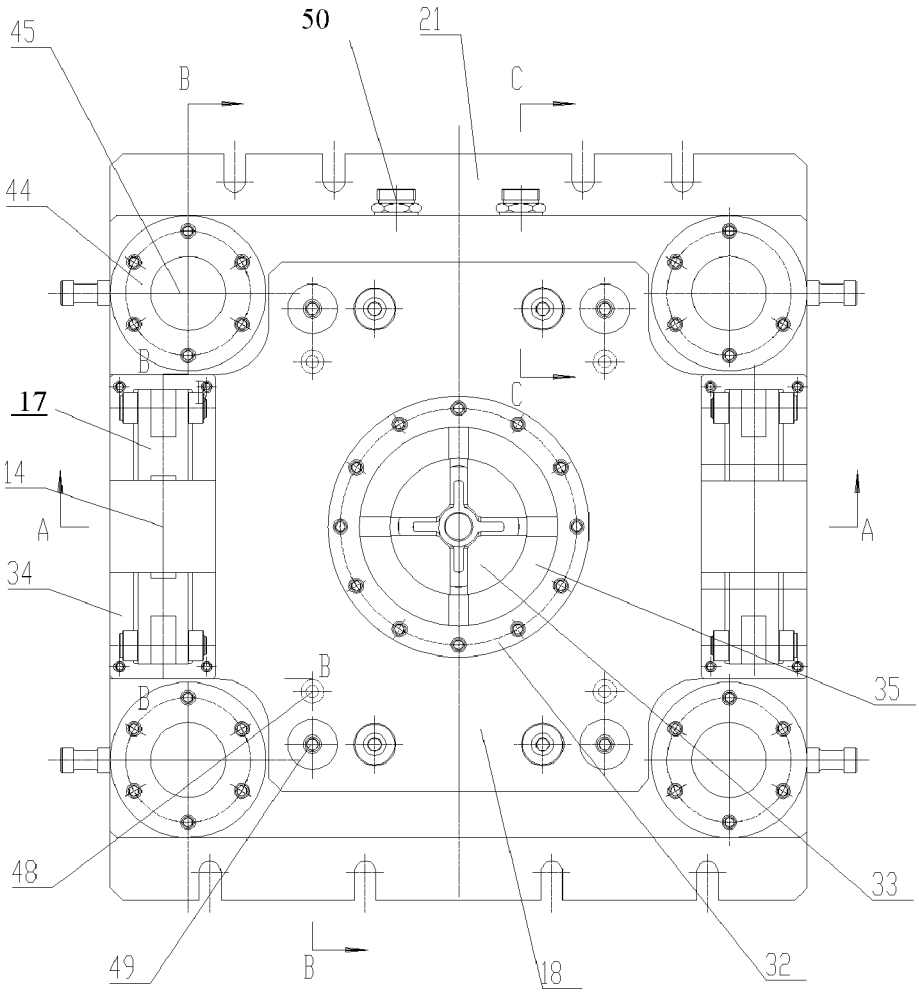
FIG. 2 is a top view after parts 1 to 13 and 37 to 43 in FIG. 1 are disassembled.
Figure 3:
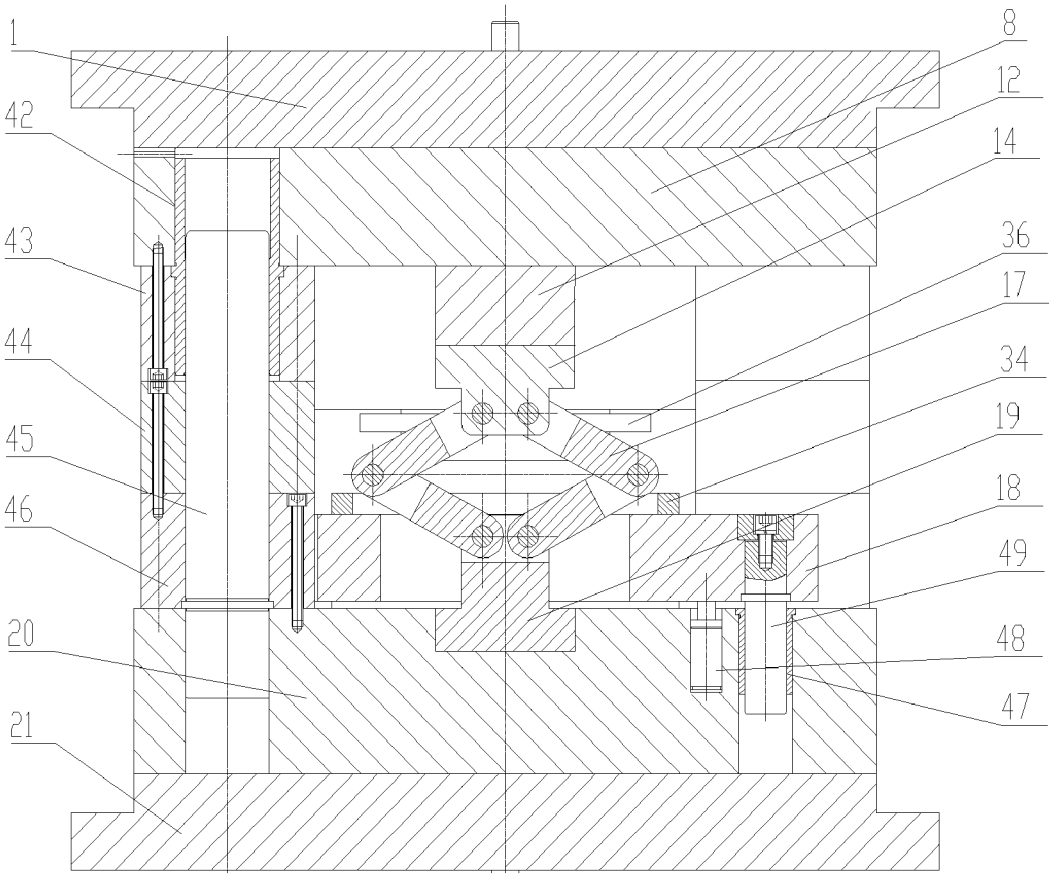
FIG. 3 is a sectional view along B-B in FIG. 2.

As shown in FIGS. 1 to 4, a double closed hydraulic mould stand according to the present invention includes an up bottom plate 1, an up bottom plate insert 2, an up pin-lift 3, an up punch pin seat 4, a cylindrical spring 5, an up cylinder bottom 6, an up annular piston 7, an up mould plate 8, an up cylinder cover 9, an up annual ring 10, an up bed piece 11, an up bearing support 12, an up stop sleeve 13, an up hinge base 14, an up concave mould seat 15, an up concave mould 16, a four-bar linkage 17, an intermediate floating plate 18, a down hinge base 19, a down mould plate 20, a down bottom plate 21, a down punch pin seat 22, a down bottom plate insert 23, a down pin-lift 24, a down gliding sleeve 25, a down cylinder bottom 26, a sealing ring 27, a down annular piston 28, a down cylinder cover 29, a down annual ring 30, a down bed piece 31, a down concave mould fixing ring 32, a down concave mould 33, a floating bed piece 34, a down concave mould prestressed ring 35, a down punch pin 36, an up concave mould fixing ring 37, an up punch pin 38, an up prestressed ring 39, an up gliding sleeve 40, a hoisting pin 41, guide sleeves 42, guide sleeve fixers 43, stop blocks 44, guide columns 45, guide columns fixers 46, small guide sleeves 47, a nitrogen gas spring 48, small guide columns 49, and pressure oil inlets 50.

Figure 4:
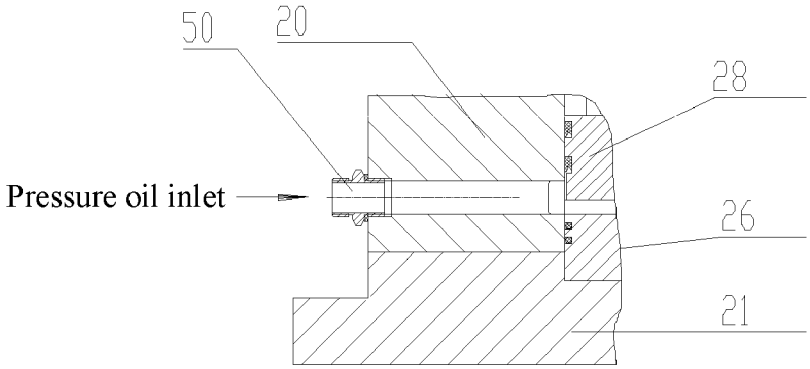
FIG. 4 is a sectional view along C-C in FIG. 2, that is, a schematic view of a pressure oil hole path on a down mould plate according to an embodiment.

A work process of a double closed hydraulic mould stand during flashless cold precision forging of a work piece is described as follows. When upper half portions of the mould and the mould stand are at upper limit positions, a billet is vertically inserted in the cross-axle down concave mould 33, and the press is turned on. The sliding block drives the upper half portions of the mould and mould stand to move downward. At first the up concave mould and the down concave mould are closed. The closed integral concave mould move downward together. Oil is discharged through the down piston cylinder pressure oil inlet 50. At the same time, the cylindrical spring 5 and the nitrogen gas spring 48 are compressed, so as to generate relative movement to the down punch pin 33 on the down punch pin seat 22 of the bearing. At the same time when the up piston cylinder and the up punch pin 38 move downward together with the sliding block, the oil is discharged through the pressure oil inlet of the up piston cylinder (a position corresponding to the up mould plate as shown in FIG. 4). At the same time, the compressed cylindrical spring 5 enables generation of relative movement between the up concave mould and the up punch pin 38, so relative movement between the up punch pin and the down punch pin is generated in the closed integral concave mould, causing plastic deformation to the billet, so as to fill in the impression of the concave mould to form a cross-axle forging. The speed ratio mechanism formed of the four-bar linkage 17 enables the up punch pin 38 and the down punch pin 36 to extrude the billet at the same speed relative to the integral concave mould, so as to ensure uniform deformation. The clamping force between the up concave mould and the down concave mould is generated by the annular piston of the up piston cylinder and down piston cylinder through oil pressure of back-pressure oil discharge, and a value of the pressure is acquired by adjusting a relief valve installed on a hydraulic system connected to the pressure oil inlet 50.

After the mould forging is ended, the upper half portions of the mould and mould stand return with the sliding block of the press. The down concave mould 33, the down bed piece 31, the intermediate floating plate 18, the down annular piston 28, and the down cylinder cover 29 returns upward rapid under the effect of the cylindrical spring 5 and the nitrogen gas spring 48. The upper limit position is limited by the down annual ring 30. While the down annular piston 28 rises rapidly, the up concave mould 16, the up concave mould seat 15, the up bed piece 11, the up cylinder cover 9, and the up annular piston 7 move downward, relative to the up gliding sleeve 40 fixed on the up bottom plate 1 at the same time when the sliding block rises, under the effect of their own weight and the cylindrical spring 5. The oil liquid in the oil tank fills an inner cavity of the up cylinder rapidly through the pressures of the vacuum and the pump. At the same time, the up punch pin seat and the down punch pin seat drive the up punch pin and the down punch pin to move downward and upward respectively through the up pin-lift and the down pin-lift, so as to push the forging out of the up concave mould or the down concave mould.

What is claimed is:

1. A double closed hydraulic mould stand comprising:

an up bottom plate (1) and an annular up mould plate (8) are connected through bolts, a down bottom plate (21) and an annular down mould plate (20) are connected through bolts, four symmetrically distributed guide sleeves (42) are fixed under the up mould plate (8), four symmetrically distributed guide columns (45) are fixed on the down mould plate (20), the guide columns (45) are sleeved by stop blocks (44), the guide sleeves (42) are on the guide columns (45) movably;

an up piston cylinder is fixed on the up bottom plate (1), an up bed piece (11) and an up concave mould (16) are connected at a cover of the up piston cylinder in sequence, the up concave mould (16) is sleeved by an up concave mould prestressed ring (39) and is fixed on the up concave mould seat (15) through an up concave mould fixing ring (37), the up concave mould seat (15) is fixedly connected to the cover of the up piston cylinder, an up pin-lift (3), an up punch pin seat (4), and an up punch pin (38) in contact in sequence form an up piston, and the up piston slidingly fits an up gliding sleeve (40), the up bed piece (11), and the up concave mould (16) from top to bottom, a down piston cylinder is fixed on the down bottom plate (21), a down bed piece (31) and a down concave mould (33) are connected at a cover of the down piston cylinder in sequence, the down concave mould (33) is sleeved by a down concave mould prestressed ring (35) and fixed on an intermediate floating plate (18) through a down concave mould fixing ring (32), the intermediate floating plate (18) is fixedly connected to the cover of the down piston cylinder, a down pin-lift (24), a down punch pin seat (22), and a down punch pin (36) in contact in sequence form a down piston, and the down piston slidingly fits a gliding sleeve (25), the down bed piece (31), and the down concave mould (33) from top to bottom;

a speed ratio mechanism is fixed between the up mould plate (8) and the down mould plate (20), the speed ratio mechanism comprises an up bearing support (12), an up hinge base (14), a down hinge base (19), a four-bar linkage (17), the intermediate floating plate (18), and small guide columns (49), two up bearing supports (12) are fixedly connected at two sides of the up mould plate (8) symmetrically, two down hinge bases (19) are fixed connected at corresponding positions at two sides of the down mould plate (20), the up bearing support (12) is connected to the up hinge base (14), the up hinge base (14) and the down hinge base (19) are connected through the four-bar linkage (17), the four symmetrically distributed small guide columns (49) are fixed under the intermediate floating plate (18), and the small guide columns (49) slidingly fit four symmetrically distributed small guide sleeves (47) disposed on the down mould plate (20) in a piston mode, an up cylinder bottom (6), an up annular piston (7), and an up cylinder cover (9) are disposed inside the up mould plate (8) in sequence and form an up piston cylinder, a circular slot is provided at a bottom surface of the annular up cylinder bottom (6) and connected to the up bottom plate (1) through bolts, an annular slot is provided at a top surface of the up annular piston (7) and connected to the up cylinder cover (9) through bolts, a cylindrical spring is installed between the annular slot of the up annular piston up and the circular slot of the up cylinder bottom (6), the up mould plate (8) serves as a cylinder body of the up piston cylinder and slidingly fits the up annular piston (7) and the up cylinder cover (9), the up concave mould seat (15) is sleeved by an up stop sleeve (13), and the up concave mould seat (15) and the up stop sleeve (13) slidingly fit each other, the up stop sleeve (13) is fixed on the up mould plate (8), a down cylinder bottom (26), a down annular piston (28), and a down cylinder cover (29) are disposed inside the down mould plate (20) in sequence and form a down piston cylinder, a circular slot is provided at a top surface of the annular down cylinder bottom (26) and connected with the down bottom plate (21) through bolts, an annular slot is provided at a bottom surface of the down annular piston (28) and connected with the down cylinder cover (29) through bolts, a cylindrical spring is installed between the annular slot of the down annular piston and the circular slot of the down cylinder bottom (26), the down mould plate (20) serves as a cylinder body of the down piston cylinder and slidingly fits the down annular piston (28) and the down cylinder cover (29), and four nitrogen gas springs (48) are symmetrically disposed on the down mould plate (20).

2. The double closed hydraulic mould stand according to claim 1, wherein an up annual ring (10) is connected at a bottom surface of the up mould plate (8), a sealing ring is installed at an inner circle of the up annual ring (10) and slidingly fits the up cylinder cover (9), a down annual ring (30) is connected at a top surface of the down mould plate (20), a sealing ring is installed at an inner circle of the down annual ring (30), and slidingly fits the down cylinder cover (29), and a contact surface between the up hinge base and the up bearing support is a plane.

3. The double closed hydraulic mould stand according to claim 1, wherein two oil holes are opened at a rear side of the up mould plate corresponding to a gap between the corresponding up cylinder bottom (6) and the up annular piston (7), two oil holes are opened at a rear side of the down mould plate corresponding to a gap between the corresponding down cylinder bottom (26) and the down annular piston (28), and each oil hole is connected to a hydraulic pump station through an oil pipe.

4. The double closed hydraulic mould stand according to claim 2, wherein two oil holes are opened at a rear side of the up mould plate corresponding to a gap between the corresponding up cylinder bottom (6) and the up annular piston (7), two oil holes are opened at a rear side of the down mould plate corresponding to a gap between the corresponding down cylinder bottom (26) and the down annular piston (28), and each oil hole is connected to a hydraulic pump station through an oil pipe.

* * * * *